US010710360B2

(12) United States Patent
van der Heijden

(10) Patent No.: US 10,710,360 B2
(45) Date of Patent: Jul. 14, 2020

(54) DEVICE THAT IS CONFIGURED TO HANDLE FOIL FOR USE IN A PRINTING PROCESS

(71) Applicant: Vinnovation Holding B.V., Rosmalen (NL)

(72) Inventor: Vincent van der Heijden, 's-Hertogenbosch (NL)

(73) Assignee: Vinnovation Holding B.V., Rosmalen (NL)

( * ) Notice: Subject to any disclaimer, the term of this patent is extended or adjusted under 35 U.S.C. 154(b) by 239 days.

(21) Appl. No.: 15/606,561

(22) Filed: May 26, 2017

(65) Prior Publication Data

US 2017/0341368 A1 Nov. 30, 2017

(30) Foreign Application Priority Data

May 30, 2016 (EP) ..... 16020201

(51) Int. Cl.
*B41F 16/00* (2006.01)
*B41F 33/00* (2006.01)

(52) U.S. Cl.
CPC ..... *B41F 33/0081* (2013.01); *B41F 16/006* (2013.01); *B41F 16/0033* (2013.01); *B65H 2403/724* (2013.01)

(58) Field of Classification Search
CPC ..... B41F 13/008; B41F 13/03; B41F 13/025; B41F 16/006; B41F 16/0033; B41F 33/0081; B41F 33/02; B41F 33/16; B41F 13/06; B41F 13/58; B41F 16/0013; B41F 19/004; B41F 19/005; B41F 19/062; B65H 2403/724
See application file for complete search history.

(56) References Cited

U.S. PATENT DOCUMENTS

2009/0078141 A1 3/2009 Yamashita et al.
2012/0193024 A1 8/2012 DeBard et al.

FOREIGN PATENT DOCUMENTS

DE 102014108744 A1 1/2015
EP 1815982 * 8/2007 ..... B41F 16/00
(Continued)

OTHER PUBLICATIONS

Extended European Search Report for Related Application, European Application No. 16020201.6, dated May 19, 2017, 15 pages.

*Primary Examiner* — Leslie J Evanisko
*Assistant Examiner* — Marissa Ferguson-Samreth
(74) *Attorney, Agent, or Firm* — Troutman Sanders LLP; Ryan Schneider

(57) ABSTRACT

A device for handling foil for use in a printing process during which portions of a layer of the foil are transferred to a substrate comprises a foil input unit for inputting at least one foil web to the device, a number of rotatable shafts and bars for directing the at least one foil web to the printing press and retrieving at least one used foil web from the printing press, an arrangement for controlling operation of the device, and a web tension feedback unit for detecting at least one characteristic related to an actual web tension during operation of the device so as to realize web tension control by adjusting motion and/or positioning of at least one of the rotatable shafts and bars in case the characteristic appears to deviate from a reference related to a set web tension.

17 Claims, 6 Drawing Sheets

(56) References Cited

FOREIGN PATENT DOCUMENTS

| | | | | | |
|---|---|---|---|---|---|
| EP | 1985448 | | * | 10/2008 | ..... B41F 16/00 |
| EP | 1997630 | | * | 12/2008 | ..... B41F 19/062 |
| EP | 2161130 | A2 | | 8/2009 | |
| EP | 2340936 | | * | 7/2011 | ..... B41F 13/06 |

* cited by examiner

DEVICE THAT IS CONFIGURED TO HANDLE FOIL FOR USE IN A PRINTING PROCESS

CROSS-REFERENCE TO RELATED APPLICATIONS

This application claims the benefit under 35 USC § 119(a)-(d) and (f) of EP 16020201.6, filed 30 May 2016, the entire contents and substance of that is hereby incorporated by reference.

BACKGROUND OF THE INVENTION

1. Field of Invention

The present invention relates to a device that is configured to handle foil for use in a printing process during which transfer portions of a layer of the foil are transferred to a substrate to be printed, the device being intended for arrangement at a printing press having a printing area designed to let such a printing process take place during operation of the printing press, and the device comprising a foil input unit that is arranged and configured to input at least one foil web to the device, a number of rotatable shafts and bars intended for arrangement upstream and downstream of the printing area, respectively, for directing the at least one foil web to the printing press and retrieving at least one used foil web from the printing press, and a controlling arrangement that is configured to control operation of the device.

The present invention also relates to a combination of a printing press and a device as mentioned, wherein the device is arranged at a position for supplying at least one foil web to the printing press, at least the foil input unit of the device preferably being at a position that is at a higher level than cylinders that are part of the printing press.

2. Background and Related Art

In general, the present invention is applicable in the field of applying a thin layer of a metal such as aluminum to a substrate such as paper or carton during a printing process, as in this field, there is a need for useful methods aimed at realizing proper transport of a foil comprising the thin metal layer and a carrier layer through a printing area of a printing press, i.e. an area where the printing process takes place during operation of the printing press. In this respect, techniques for transferring the metal layer from the carrier layer of the foil to the substrate have been developed that do not require any heating process for letting the desired transfer take place. The foil that is used in carrying out these techniques usually comprises a carrier layer made of polyethylene, wherein a layer of aluminum is deposited on this carrier layer. In the following, for sake of clarity, the term "transfer layer" will be used as a general term for the layer that is suitable for transfer to the substrate.

By using the foil as described in the foregoing, it is possible to realize printed matter having shiny, silver-like or gold-like portions, wherein the exact color of the portions is dependent on the color of the transfer layer of the foil that has been used during the printing process. In particular, the shiny portions are obtained by performing the following steps: applying a specific type of glue to predetermined areas on the substrate to be printed; and pressing the substrate and a length of the foil against each other, with the transfer layer of the foil facing the substrate. During the latter step, a transfer of the transfer layer from the carrier layer of the foil to the substrate to be printed takes place at the areas where the glue is present, so that the material of the transfer layer is arranged on the substrate according to the pattern of the glue. As mentioned, examples of the substrate include paper or carton. The substrate may be a plano that is intended to be folded to a box, for example.

The foil is normally taken as a web from a reel, which is unwound during a printing process in which the foil is used, so that the supply of foil can be continuous. In the printing press, the foil web is moved through a nip between two cylinders of the printing press, wherein the substrate to be printed is arranged on one of the cylinders. At a position where the foil web is pressed against the substrate on the basis of pressing forces that are exerted on the foil due to interaction of the two cylinders of the printing press, predetermined portions of the transfer layer are transferred from the foil web to the substrate. After a length of foil web has passed the nip between the cylinders of the printing press, and some portions of the transfer layer of the length of foil web have been used in the process of printing a substrate, the length of remaining foil is disposed of. For example, the foil web moves on to a device that is arranged and configured to shred the foil, or the foil web is wound on a reel.

A device as defined in the opening paragraph is known, for example, from EP 2 340 936 A1, which is hereby incorporated by reference. This patent publication relates to a method and a device for supplying foil to a printing press, which method and device are suitable to be applied for reusing a length of foil web that has already been used in a printing process. In an exemplary embodiment of the device, a foil reuse unit is present, which is arranged and configured to receive a used length of foil web from the printing press, to change a mutual position of the length of foil web and the printing press, and to feed the length of foil web back to the printing press. By changing the mutual position as mentioned, it is ensured that portions of a substrate to which transfer portions of a transfer layer of the foil need to be transferred are covered by unused portions of the length of foil web. The actions performed by the foil reuse unit can be repeated until there are no portions left on the length of foil web that can be used for covering portions of the substrate that need to be provided with the transfer portions. In general, reuse of a length of foil web, which may take place one time or more than one time, leads to reduction of waste of foil and thereby to reduction of costs.

In a device as defined in the opening paragraph, it is important to have proper control of the operation of the device, which is aimed at realizing correct positioning of the foil in the printing area of the printing press, and also at transporting the foil through the printing area at a correct speed, i.e. a speed that is exactly adapted to the speed of the substrate to be printed. Also, maintaining proper web tension is an issue in the operation of the device. If the web tension is too low, the printing process may be hampered, and if the web tension is too high, the result of the printing process may be of bad quality, with the actual printed pattern of the foil on the substrate deviating significantly from a printed pattern as intended.

Among other things, as mentioned, the device comprises a foil input unit for inputting at least one foil web to the device. In an exemplary embodiment, the foil input unit comprises a rotatable input carrier shaft for carrying at least one reel of foil and reeling out foil of the at least one reel. For the purpose of controlling web tension of a foil web supplied by the foil input unit, it is known to use a dancer contacting the foil web, and a pneumatic cylinder for setting the position of the dancer. A disadvantage of this known option is that the dancer touches the transfer layer of the foil, which may cause damage to the transfer layer and, as a consequence, may involve poor printing results. According to another known option, web tension is controlled by controlling the rotational speed of the reel from which the foil is taken, wherein it is intended to create web tension by setting the rotational speed of the reel at a value that is associated with a somewhat lower speed of the foil web than in areas downstream of the foil input unit, so that a kind of pulling effect on the foil web is obtained. Controlling the rotational speed of the reel as mentioned is done by having a slipping arrangement of the reel on the input carrier shaft and controlling the extent to which the reel is allowed to slip with respect to the input carrier shaft, in which case the input carrier shaft is a so-called tension shaft having segments at which the diameter of the shaft can be varied pneumatically. It is noted that the use of a tension shaft as the input carrier shaft is well known for the reason that such use is practical in case it is desired to take foil from two or more reels simultaneously. By having individual control of slip between respective reels and the shaft, it is possible to realize equal speed of the respective foil webs leaving the foil input unit in spite of (slight) diameter differences between the respective reels. However, it appears that controlling web tension through controlling an extent of slip between a reel and a tension shaft does not yield accurate results due to the pneumatic character of the control. Also, in case a significant extent of slip is realized, problems relating to generation of heat arise.

BRIEF SUMMARY OF THE INVENTION

Briefly described, in a preferred form according to the invention, in view of the desire to realize proper control of the web tension so that excellent printing results may achieved, a device as mentioned in the opening paragraph is equipped with a web tension feedback unit that is arranged and configured to detect at least one characteristic related to web tension during operation of the device, wherein the web tension feedback unit is in communication with the controlling arrangement, wherein the controlling arrangement is configured to receive information from the web tension feedback unit about the detected characteristic and to process the information by comparing the information to a reference, and to adjust motion and/or positioning of at least one of the rotatable shafts and bars in case the information appears to deviate from the reference.

According to a first exemplary embodiment, the web tension feedback unit comprises a visual inspection unit that is arranged and configured to visually inspect an actual pattern of removed transfer portions in a used length of at least one foil web, and wherein the reference applied by the controlling arrangement while processing information received from the web tension feedback unit represents a reference pattern of removed transfer portions. Thus, in that case, a process of determining whether the web tension is at a proper level is performed by visually inspecting an actual pattern of removed transfer portions in a used length of a foil web, wherein the actual pattern is compared to a reference, e.g. by using image recognition techniques. Such a process is especially applicable for guaranteeing that the web tension cannot be too high, based on the insight that the shape of the printed pattern can be used as a visual indicator of the web tension. Particularly, it can be concluded that the web tension is too high when the printed pattern is stretched in the longitudinal direction with respect to a reference pattern. When it is found that the web tension is too high, indeed, the web tension can be adjusted by adjusting motion and/or positioning of at least one bar or shaft on which the foil web runs. The information provided by the visual inspection unit may also be used for assessing whether positioning of the printed pattern in a transverse direction is correct. The fact is that in case correction is needed, such can be done by adjusting positioning of at least one of the rotatable shafts and bars.

In any case, when visual inspection of an actual pattern of removed transfer portions reveals that the web tension is too high, it is practical to operate the controlling arrangement to slow down at least one of the rotatable shafts and bars arranged downstream of the printing area and/or to speed up at least one of the rotatable shafts and bars arranged upstream of the printing area in case an actual pattern of removed transfer portions appears to deviate from a reference pattern of removed transfer portions.

According to a second exemplary embodiment, the web tension feedback unit comprises a pressure detection unit that is arranged and configured to detect pressure exerted by the foil web on at least one area of at least one of the rotatable shafts and bars, and wherein the reference applied by the controlling arrangement while processing information received from the web tension feedback unit represents a reference pressure. Thus, also in that case, it is possible to perform web tension measurements in order to obtain information about an actual web tension and to have a possibility of making adjustments in case the web tension appears to deviate from a reference. For example, one or more bars on which a web runs may be equipped with cells for measuring forces applied to the bar by the foil web.

According to a third exemplary embodiment, the web tension feedback unit comprises a position detection unit that is arranged and configured to detect a position of at least one of the rotatable shafts and bars with respect to a carrier frame, wherein the at least one of the rotatable shafts and bars is resiliently mounted on the carrier frame, and wherein the reference applied by the controlling arrangement while processing information received from the web tension feedback unit represents a reference position. As the mounting of the at least one of the rotatable shafts and bars on the carrier frame is of a resilient nature, wherein the at least one of the rotatable shafts and bars may be coupled to the carrier frame through one or more suitable springs, for example, the position in the carrier frame of the at least one of the rotatable shafts and bars is influenced by the tension of the web running on the at least one of the rotatable shafts and bars. Hence, the position as mentioned can be taken as a measure of the web tension.

The first, the second and the third exemplary embodiments as explained in the foregoing may be applied as alternatives, but it also possible to have a combination of at least two of those options in one device. In the latter case, an indication of an actual value of the web tension is obtained in at least two different ways, wherein it is possible to determine an average value, for example.

In an aspect, the present invention involves advantageous options in respect of an input driving system that is applied in the device for driving an input carrier shaft of the foil input unit. In particular, assuming that the input driving system comprises a motor and a coupling unit arranged between the motor and the input carrier shaft, it may be so that the coupling unit of the input driving system comprises an electronically controllable device including two rotatably arranged coupling components and a medium situated between surfaces of the coupling components facing each other, the motor of the input driving system, that may be many suitable types of servo motor, for example, being arranged to drive one of the coupling components, and the controlling arrangement being configured to control an extent of slip between the surfaces of the coupling components by varying an extent to which the medium is allowed to couple the surfaces of the coupling components to each other. On the basis thereof, the present invention provides an improved way of controlling the rotational speed of the input carrier shaft, that is also an improved way of controlling the rotational speed of a reel arranged on the input carrier shaft and thereby controlling web tension. It is noted that it is still possible within the framework of the present invention for the input carrier shaft to be a tension shaft, which is advantageous in view of the option of having more than one reel on the shaft. However, in such a case, control of the rotational speed of a reel does not primarily rely on control of an extent of slip between the reel and the shaft, but rather on control of motion of the shaft, that can be performed in a much more accurate way, as the control is of an electronic character instead of a pneumatic character.

During operation of the device according to the invention, the input driving system is controlled by the controlling arrangement of the device so as to realize rotation of the input carrier shaft at a speed that is suitable for realizing correct web tension and correct speed of a foil web in the printing area of the printing press. In the process, the extent of slip between the surfaces of the coupling components of the electronically controllable device is controlled, wherein the medium that is present between the surfaces is allowed to couple the surfaces to each other to a greater or lesser extent, whatever is appropriate in a given situation. It is noted that in a coupling unit comprising such a type of device, there are no problems with heat generation as the surfaces do not contact each other directly but through the medium only.

Characteristics of the control of the input driving system may be determined on the basis of information about the rotational speed of one or more rotatable bars arranged downstream of the printing area, wherein an appropriate value of web tension is realized by having a web speed that is somewhat higher downstream of the printing area of the printing press, and that is somewhat lower upstream of the printing area. Also, the feedback relating to the actual web tension may be used in many suitable ways, in which case the controlling arrangement may particularly be configured to determine if it is necessary to adjust the extent of slip between the surfaces of the coupling components of the electronically controllable device in order to adjust the speed of rotation of the input carrier shaft.

The electronically controllable device may be a magnetic powder clutch including two rotors and magnetic powder particles situated between surfaces of the rotors facing each other, the controlling arrangement being configured to control an extent of slip between the surfaces of the rotors by varying a supply of electrical power to the magnetic powder clutch. Besides the option of having accurate control of the rotational speed of the input carrier shaft and at least one reel of foil arranged thereon, applying a magnetic powder clutch also offers a practical option of initiating rotation of the input carrier shaft at maximum torque and subsequently turning down the torque.

As already suggested in the foregoing, the input carrier shaft may be designed to carry at least two reels of foil and to engage the reels of foil in a slipping fashion, the input carrier shaft being equipped with a mechanism for varying the extent of slip between the respective reels of foil and the input carrier shaft, and the controlling arrangement being configured to control the mechanism. In such a case, it is possible to have more than one reel on the input carrier shaft on the one hand and to compensate for diameter differences between the respective reels on the other hand.

It is not only possible for the device according to the present invention to comprise a foil input unit, but also to comprise a foil collection unit for collecting used foil, particularly a foil collection unit that comprises a rotatable output carrier shaft for carrying at least one reel of foil and reeling in foil to the at least one reel, and an output driving system for driving the output carrier shaft, wherein, in a similar way as is the case with the foil input unit, the output driving system may comprise a motor and a coupling unit arranged between the motor and the output carrier shaft, wherein the coupling unit of the output driving system may comprise an electronically controllable device including two rotatably arranged coupling components and a medium situated between surfaces of the coupling components facing each other, wherein the motor of the output driving system, that may be many suitable types of servo motor, for example, is arranged to drive one of the coupling components, and wherein the controlling arrangement is configured to control an extent of slip between the surfaces of the coupling components by varying an extent to which the medium is allowed to couple the surfaces of the coupling components to each other. In the case that the device comprises a foil collection unit as mentioned, it is possible to realize accurate control of the rotational speed of the output carrier shaft and a reel arranged on the shaft, and to thereby contribute to realizing accurate control of web tension, as already explained in the foregoing with respect to the foil input unit.

The options as mentioned in respect of the foil input unit that is equipped with an electronically controllable device including two coupling components and a medium situated between surfaces of the coupling components facing each other are equally applicable to the foil collection unit that is equipped with such electronically controllable device. Hence, the electronically controllable device may be a magnetic powder clutch including two rotors and magnetic powder particles situated between surfaces of the rotors facing each other, the controlling arrangement being configured to control an extent of slip between the surfaces of the rotors by varying a supply of electrical power to the magnetic powder clutch. Also, the output carrier shaft may be designed to carry at least two reels of foil and to engage the reels of foil in a slipping fashion, the output carrier shaft being equipped with a mechanism for varying the extent of slip between the respective reels of foil and the output carrier shaft, and the controlling arrangement being configured to control the mechanism, in which case the output carrier shaft can be a tension shaft as mentioned earlier.

In general, it may be so that the device according to the present invention is equipped with a foil reuse unit, like the device known from EP 2 340 936 A1. In particular, the device according to the present invention may comprise a foil reuse unit for receiving a used length of foil web from a printing press and feeding the same length of foil web back to the printing press in a longitudinally shifted position so as to allow the printing press to take transfer portions from the length of foil web at positions of the length of foil web that have not been addressed during previous use of the length of foil web in the printing process. In this respect, it is noted that it is possible for the foil reuse unit to be operable in one of two conditions, namely a first condition for reusing a single length of foil web up to a maximum of two times, and a second condition for simultaneously reusing two lengths of foil web one time.

Furthermore, it is possible for the foil reuse unit to comprise an arrangement of at least two elements for contacting and supporting a length of foil web in the foil reuse unit, the mutual position of the elements in the foil reuse unit being adjustable, wherein optionally the arrangement as mentioned is incorporated in a movably arranged frame portion. The arrangement as mentioned may be an adjustable angle bar arrangement, for example. In such a case, a system for controlling positions of the angle bars in the adjustable angle bar arrangement and/or a level of the frame portion in the device on the basis of information regarding a positioning of unused portions of foil and positioning of portions of the substrate to be provided with transfer portions may be used in order to ensure that foil is reused in such a manner that the portions of the substrate are covered by portions of the foil that have not been addressed earlier in the printing process.

According to an advantageous option, the device according to the present invention may comprise at least one direct foil supply bar for supplying a foil web to a printing press, the direct foil supply bar being driven by a motor, and the controlling arrangement being configured to control the motor. According to this option, web speed and web tension are not only controlled at the input side of the printing press on the basis of control of operation of the foil input unit, but also on the basis of control of the rotation of an additional direct foil supply bar arranged downstream of the foil input unit. In fact, this direct foil supply bar can have a primary function in ensuring that the speed at which the foil travels through the printing area of the printing press corresponds to the speed at which the substrate to be printed travels through the printing area, wherein the latter speed is related to the rotational speed of a cylinder of the printing press for supporting the substrate. In practical situations, this direct foil supply bar is used with a motion detection unit for detecting motion of the cylinder as mentioned, wherein the motion detection unit is in communication with the controlling arrangement, and wherein the controlling arrangement is configured to process information from the motion detection unit and to control the motor for driving the direct foil supply bar for adjusting the speed of a foil web at the position of the direct foil supply bar to the speed of a substrate in the printing area. In the art, the direct foil supply bar is referred to as being part of a direct foil drive system of the device, and the motion detection unit may comprise a suitable type of encoder. The motor for driving the direct foil supply bar may be many suitable types of servo motor.

According to a third exemplary embodiment, the web tension feedback unit comprises a visual inspection unit that is arranged and configured to visually inspect reference marks on at least one foil web, and wherein the controlling arrangement is configured to receive and process information from the web tension feedback unit about the longitudinal positions of the reference marks and to temporarily adjust motion of the direct foil supply bar in case the longitudinal positions of the reference marks appear to deviate from reference longitudinal positions, during a time that the foil web is allowed to run free in the printing area of the printing press, for adjusting positioning of the foil web in a longitudinal direction during that time. In the art, it is known to apply foils that are provided with a repetitive pattern of symbols, letters, images, etc. for realizing a kind of holographic tessellation on one or more areas of a substrate, or on an entire substrate. It is desired to provide a way of accurately positioning the pattern on a substrate, so that the pattern is printed on subsequent substrates in a reproducible manner. In the art, it is not possible to have such reproducible manner of printing a repetitive pattern, and as a consequence, the designs of the prints that can be realized by means of the foil are limited in the sense that the designs should allow the repetitive pattern to be present on the substrate in a random fashion. For example, in the art, it is not possible to have a design in which a certain portion of the pattern can be positioned in a printed frame, as there is no way of guaranteeing that the portion is printed at the exact position where subsequently the frame will be printed.

The present invention offers a way of checking the longitudinal positioning of a foil web and correcting the longitudinal positioning if it appears to be necessary to do so, wherein use is made of the fact that in a printing process, the web is allowed to run free in the printing area of the printing press during a period of each rotation of the cylinders in the printing area, namely when gaps as present in the cylinders are in a position of facing each other. The fact is that it is common use for cylinders of an offset printing press to be provided with a gap, particularly a break in the circumference, which has a function in accommodating gripping or clamping elements. For example, in the case of a blanket cylinder of an offset printing press, elements for holding the blanket to the cylinder are present in the gap, and in the case of an impression cylinder of an offset printing press, elements for gripping the substrate to be printed and carrying the substrate through the printing area are present in the gap. For the sake of completeness, it is noted that the longitudinal direction should be understood such as to be a direction along the foil web that is associated with primary motion of the foil web, i.e. motion that is related to the foil web being wound off a reel, and that is a direction in which the foil web can be said to have length as opposed to a transverse direction in which the foil web can be said to have width.

For the sake of completeness, it is noted that the reference marks may be marks that are separate from a pattern to be transferred from the foil web to the substrate, but that does not alter the fact that the marks may also be parts of such a pattern that are suitable to function as marks. Also, it is noted that the third exemplary embodiment of the present invention may be combined with at least one of the first exemplary embodiment and the second exemplary embodiment as described in the foregoing, but that this is not necessary.

These and other objects, features and advantages of the present invention will become more apparent upon reading the following specification in conjunction with the accompanying drawing figures.

BRIEF DESCRIPTION OF THE DRAWINGS

Embodiments of the present invention will be now described by way of example only with reference to the accompanying drawings in which.

Figure 1:
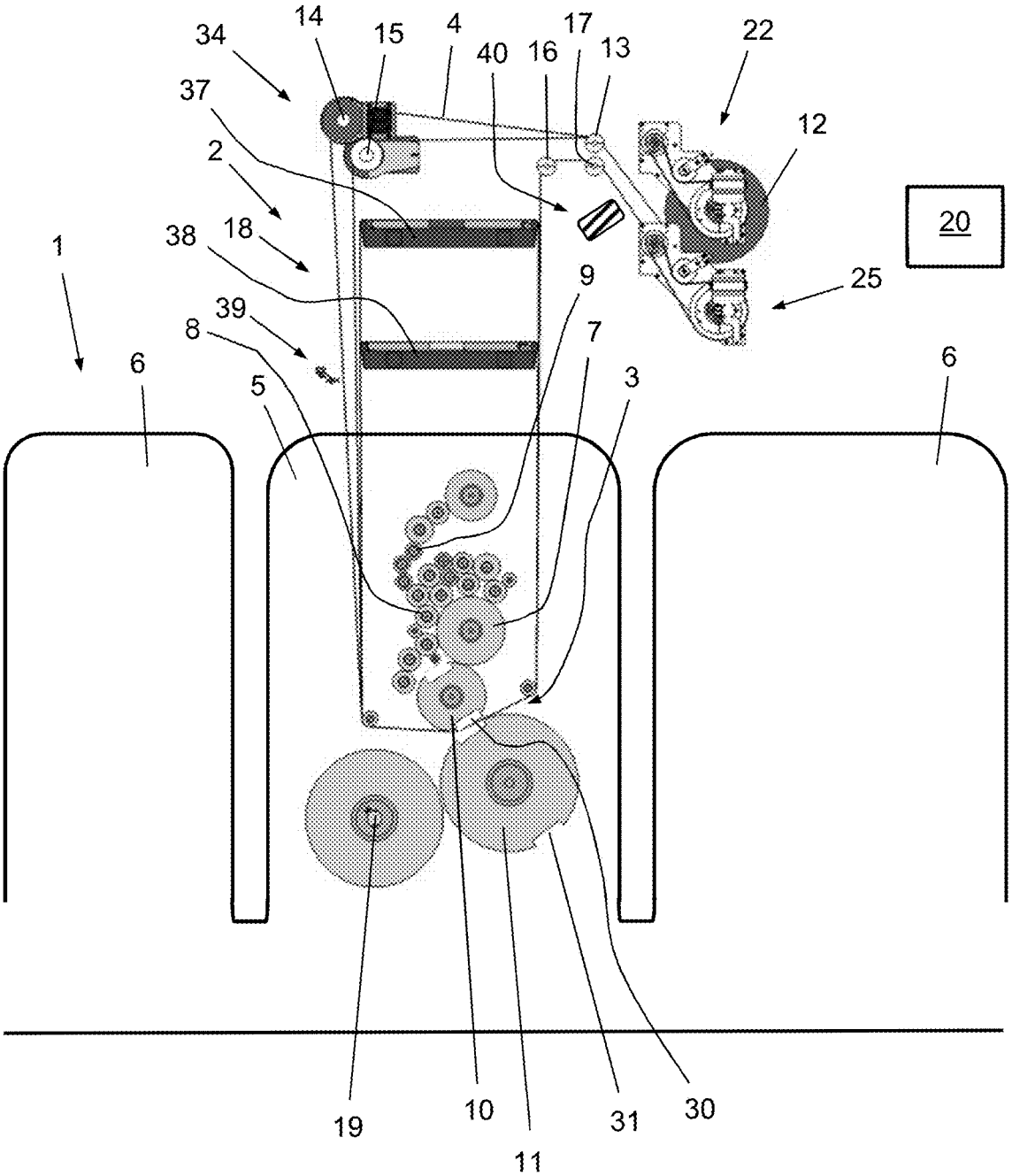
FIG. 1 shows a foil handling device according to the present invention and a portion of a printing press.

The figures are of a diagrammatical nature only and not drawn to scale.

DETAILED DESCRIPTION OF THE PREFERRED EMBODIMENTS

To facilitate an understanding of the principles and features of the various embodiments of the invention, various illustrative embodiments are explained below. Although exemplary embodiments of the present invention are explained in detail, it is to be understood that other embodiments are contemplated. Accordingly, it is not intended that the present invention is limited in its scope to the details of construction and arrangement of components set forth in the following description or illustrated in the drawings. The present invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the present invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

As shown and described, the present invention is a device 2 comprising a foil input unit 22 with a foil web 4, a shaft and bar arrangement 13, 14, 15, 16, 17, 21, 27 providing unused foil web 4 to a printing press 1 and retrieving used foil web 4 from the printing press 1, a web tension feedback unit 39, 40, 42 to detect a characteristic related to foil web 4 tension and a controlling arrangement 20 configured to receive the characteristic related to foil web 4 tension from the web tension feedback unit 39, 40, 42, to identify an operable deviation between the characteristic and a reference, and to control the shaft and bar arrangement 13, 14, 15, 16, 17, 21, 27 in response to the identification of the operable deviation. If the deviation between the identified characteristic related to foil web 4 tension and the reference is not great enough to warrant operational changes to the device, then the deviation does not rise to the level of an "operable deviation," and the controlling arrangement 20 would not be necessarily trigger any adjustment/control to the shaft and bar arrangement 13, 14, 15, 16, 17, 21, 27 beyond its then current operation until such an operable deviation were detected/determined.

In another exemplary embodiment as shown and described, the device is configured to handle foil for use in a printing process during which transfer portions of a layer of the foil are transferred to a substrate to be printed. The present device is intended for arrangement at a printing press having a printing area designed to let such a printing process take place during operation of the printing press. The device comprises the foil input unit that is arranged and configured to input at least one foil web to the device, the shaft and bar arrangement comprising rotatable shafts and bars for arrangement upstream and downstream of the printing area of the printing press, respectively, for directing the at least one foil web to the printing press and retrieving at least one used foil web from the printing press, the controlling arrangement that is configured to control operation of the device, and the web tension feedback unit that is arranged and configured to detect the characteristics related to web tension during operation of the device, wherein the web tension feedback unit is in communication with the controlling arrangement, and wherein the controlling arrangement is configured to receive information from the web tension feedback unit about the detected characteristic and to process the information by comparing the information to a reference, and to adjust motion and/or positioning of at least one of the rotatable shafts and bars of the shaft and bar arrangement in case the information appears to deviate from the reference to the extent that the shaft and bar arrangement should be adjusted, herein sometimes referred to as an operable deviation.

In another exemplary embodiment as shown and described, the present invention is a device 2 for handling foil for use in a printing process during which portions of a layer of the foil are transferred to a substrate comprises a foil input unit 22 for inputting at least one foil web 4, 4*a*, 4*b* to the device 2, a number of rotatable shafts 21, 27 and bars 13, 14, 15, 16, 17 for directing the at least one foil web 4, 4*a*, 4*b* to the printing press 1 and retrieving at least one used foil web 4, 4*a*, 4*b* from the printing press 1, an arrangement 20 for controlling operation of the device 2, and a web tension feedback unit 39, 40, 42 for detecting at least one characteristic related to an actual web tension during operation of the device 2 so as to realize web tension control by adjusting motion and/or positioning of at least one of the rotatable shafts 21, 27 and bars 13, 14, 15, 16, 17 in case the characteristic appears to deviate from a reference related to a set web tension.

FIG. 1 illustrates a combination of a printing press 1 and a device 2 according to the present invention, which serves for handling foil for use in a printing process to be performed in a printing area 3 of the printing press 1. In the shown example, the foil is provided in the form of at least one foil web 4. In particular, the foil comprises two layers, namely a transfer layer such as a metal layer, and a carrier layer. It is intended to have a transfer of portions of the transfer layer from the carrier layer to a substrate (not shown in FIG. 1) such as a sheet of paper or a web of paper in the printing press 1, so that shiny portions are obtained on this substrate. The transfer may be realized in a way known per se, for example, by applying glue to the substrate to be printed and pressing the foil against the substrate, in such a way that the transfer layer of the foil contacts the substrate and is removed from the carrier layer at the areas where the glue is present.

With respect to the printing press 1, it is noted that this may be many types of printing press 1 that is capable of processing the foil and making shiny portions on printed matter by using the foil. In the example as shown in FIG. 1, the printing press 1 is a so-called offset press, and comprises a number of printing units, wherein one unit is used as a foil printing unit 5 for adding foil to the substrate to be printed, and wherein other units are used as ink printing units 6 for adding various colors to the substrate. The foil printing unit 5 and the ink printing units 6 may be arranged in many suitable orders, depending on a desired sequence of applying foil to the substrate and printing ink on the substrate. A number of cylinders as present in the foil printing unit 5 of the printing press 1 are diagrammatically depicted in FIG. 1. Generally speaking, the foil handling device 2 is arranged at a position above the foil printing unit 5, so that application of the foil handling device 2 with the printing press 1 does not add to the amount of floor space that is needed for the printing press 1.

In each of the printing units 5, 6 of the printing press 1, a plate cylinder 7 is arranged, that is a carrier of a printing plate. During a printing process, glue or ink is supplied to the printing plate by means of glue/ink cylinders 8 that are arranged in the printing unit 5, 6 as well. Furthermore, dampening cylinders 9 are arranged in the printing unit 5, 6. Areas of the printing plate that are not having an image to be transferred to the substrate are kept in a humid state, as a result of which the ink cannot settle in these areas. According to the principles of offset printing technology, the image is not transferred directly from the printing plate to the substrate. Instead, an intermediate step is performed, in which a blanket is used for receiving the image from the printing plate and transferring the image to the substrate. In the printing unit 5, 6, the blanket is mounted on a blanket cylinder 10 that is arranged at a position between the plate cylinder 7 and a cylinder 11 for supporting the substrate. This substrate supporting cylinder 11 could be an impression cylinder in case of a sheet fed press or a blanket cylinder in case of a web press.

As the offset printing process is known per se, this process will not be further explained here. In the context of the present invention, it is important to note that the foil web 4 is intended to be supplied to the printing area 3 of the printing press 1, that is an area between the blanket cylinder 10 and the substrate supporting cylinder 11 as present in the foil printing unit 5, wherein measures are taken to maintain a proper web tension.

The foil web 4 is normally taken from a reel 12, and the foil handling device 2 according to the present invention is designed to realize a continuous supply of foil to the printing press 1. Furthermore, the foil handling device 2 according to the present invention comprises a number of shafts and bars for directing the at least one foil web 4 to the printing press 1 and retrieving at least one used foil web 4 from the printing press 1. In the shown example, the foil handling device 2 comprises a non-driven input bar 13 that is situated at a foil input side of the printing press 1, two driven direct foil supply bars 14, 15 that are also situated at the foil input side of the printing press 1, and two non-driven output bars 16, 17 that are situated at a foil output side of the printing press 1. The foil handling device 2 is suitable for handling one or more foil webs 4, whatever the case may be. In the example as shown, the foil handling device 2 is suitable for handling one or two foil webs 4, and in view thereof, is equipped with two direct foil supply bars 14, 15, wherein only one direct foil supply bar 14, 15 is driven in a case of one foil web 4 being used, and wherein both direct foil supply bars 14, 15 are driven in a case of two foil webs 4 being used.

The foil handling device 2 is equipped with a unit 18 that is arranged and configured to receive a used length of foil web 4 from the printing press 1, and to feed the length of foil web 4 back to the printing press 1, while changing a mutual position of the length of foil web 4 and the printing press 1. In view thereof, the unit 18 is referred to as foil reuse unit 18. It is noted that further details of the foil reuse unit 18 and an explanation of the way in which this unit 18 is operated will be given later, with reference to FIG. 2.

Figure 3:
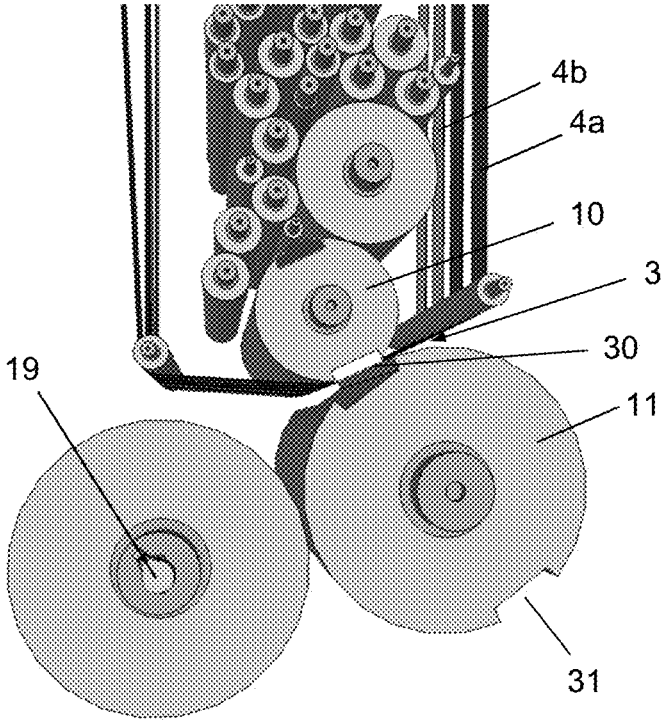
FIG. 3 shows a perspective view of a number of printing cylinders as present in a portion of the printing press including a printing area of the printing press, and portions of foil webs running through the portion of the printing press as shown.

In order to achieve excellent printing results, it is important that the speed of the foil web 4 corresponds to the speed of the substrate in the printing press 1. In view of this, the foil handling device 2 is equipped with an encoder unit 19 for detecting the speed of the substrate by detecting the rotational speed of the substrate supporting cylinder 11 of the printing press 1, as can best be seen in FIG. 3. Also, the foil handling device 2 is equipped with a suitable controlling arrangement 20 for controlling operation of the device 2, which is only diagrammatically depicted in FIG. 1 as a block. Among other things, the controlling arrangement 20 is configured to process information provided by the encoder unit 19 during operation, and to control the way in which one of the direct foil supply bars 14, 15 is driven or both of the direct foil supply bars 14, 15 are driven, so as to continually adjust the speed of a foil web 4 at the position of the relevant foil supply bar 14, 15 in order to exactly realize an intended speed of the foil web 4 in the printing area 3, that corresponds to an actual speed of the substrate to be printed.

Figure 2:
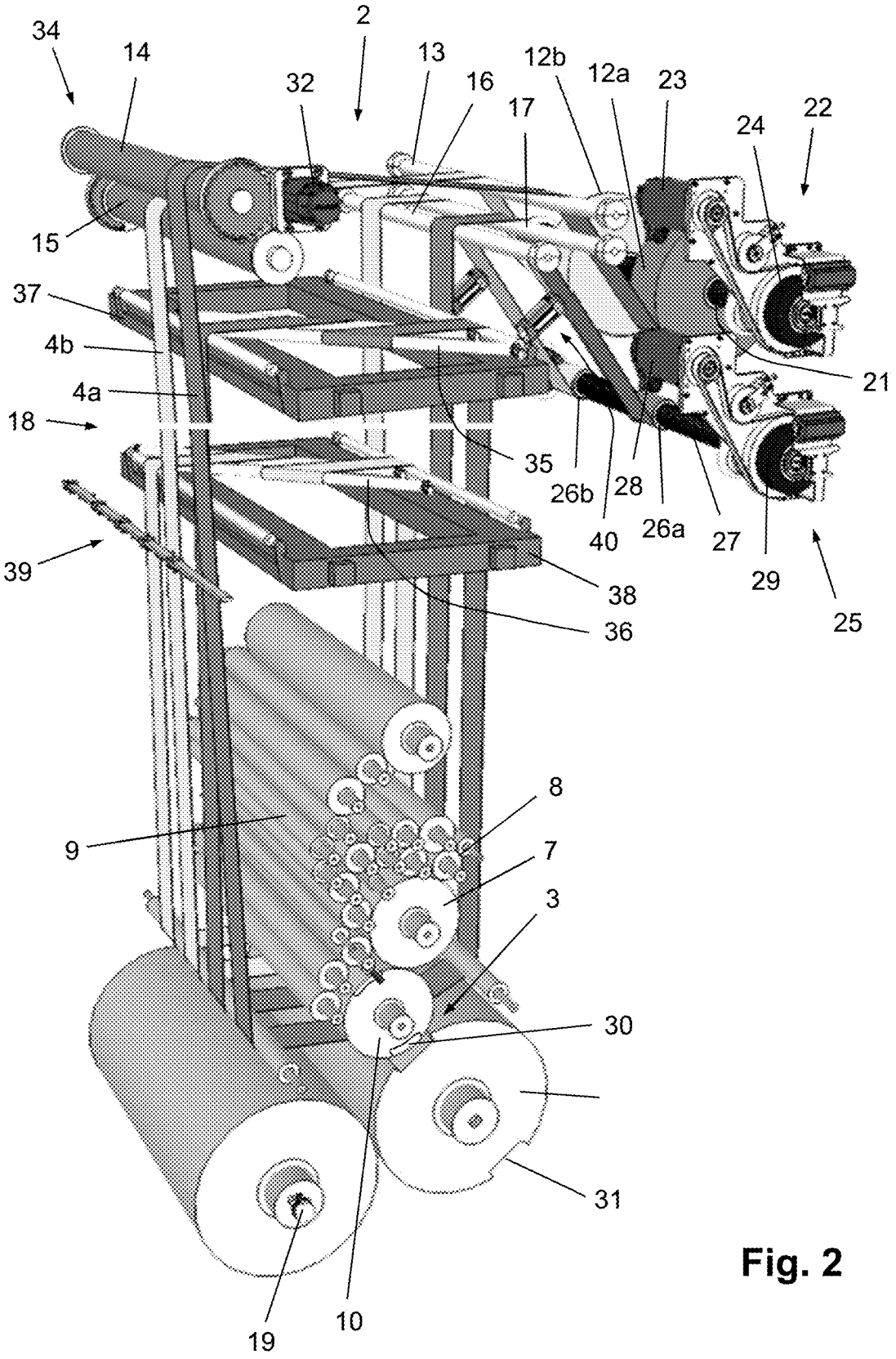
FIG. 2 shows a perspective view of components of the foil handling device according to the invention, a number of printing cylinders of the printing press, and foil that is used and reused in a printing process.

A perspective view of components of the foil handling device 2, a number of cylinders 7, 8, 9, 10, 11 of the foil printing unit 5 of the printing press 1, and foil that is used and reused in a printing process are shown in FIG. 2. In the shown example, two foil webs 4*a*, 4*b* are taken from two respective reels 12*a*, 12*b*. For the purpose of handling the two foil webs 4*a*, 4*b*, both direct foil supply bars 14, 15 are driven to supply the respective foil webs 4*a*, 4*b* to the printing area 3. Both reels 12*a*, 12*b* are supported on a rotatable input carrier shaft 21 that is part of a foil input unit 22 of the foil handling device 2, which foil input unit 22 furthermore comprises an input driving system for driving the input carrier shaft 21. In the shown example, the input driving system comprises a servo motor 23 and a magnetic powder clutch 24 for coupling the motor 23 to the input carrier shaft 21. Both the servo motor 23 and the magnetic powder clutch 24 are electronically controlled by the controlling arrangement 20, so that it is possible to accurately set a speed at which the respective foil webs 4*a*, 4*b* run from the foil input unit 22. It is noted that the magnetic powder clutch 24 is one example of a device for controlling slip between rotatable parts that may be used in the foil handling device 2.

In general, a magnetic powder clutch is an electronically controllable device that is suitable to be used for varying an amount of slip between two rotatable parts coupled through the magnetic powder clutch, which are the input carrier shaft 21 and an output shaft of the servo motor 23 in the shown example. To that end, a magnetic powder clutch comprises two rotors and magnetic powder particles situated between surfaces of the rotors facing each other. When a magnetic field is applied to the particles, the particles are made to form chains between the rotors. The strength of the chains depends on the strength of the magnetic field, and for that reason, it is possible to accurately control friction prevailing inside a magnetic powder clutch by controlling a supply of electrical power to the magnetic powder clutch.

Figure 4:
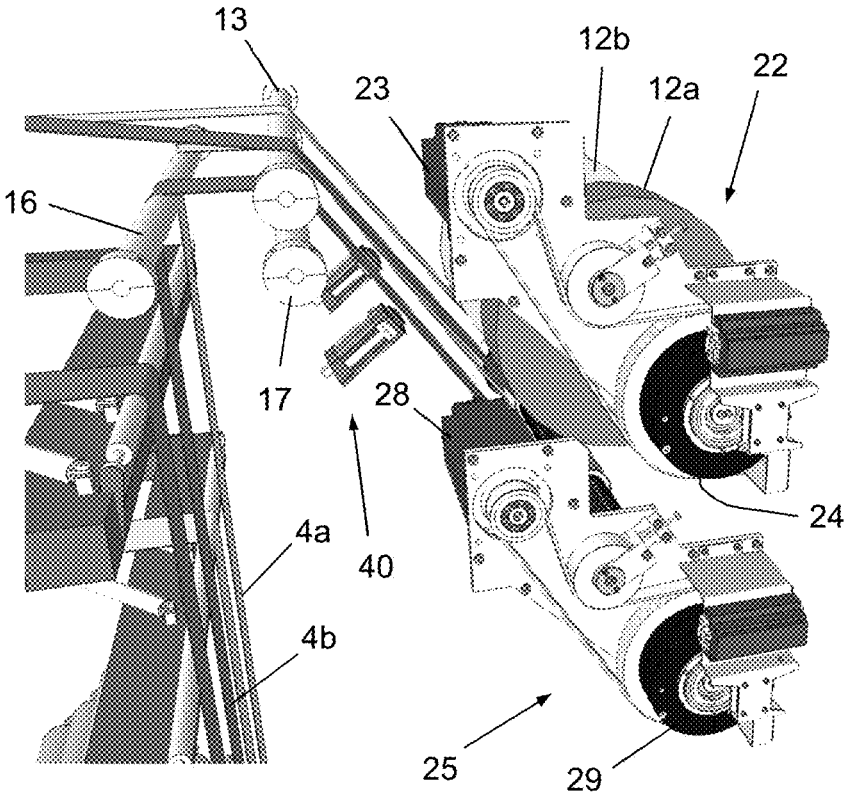
FIG. 4 shows a perspective view of a number of components as present in a first portion of the foil handling device according to the invention, including components of a foil input unit of the foil handling device, components of a foil collection unit of the foil handling device, and portions of foil webs running through the portion of the foil handling device as shown.

The foil handling device 2 does not only comprise a foil input unit 22, but also a foil collection unit 25. The latter serves for receiving a portion of each of the foil webs 4*a*, 4*b* that is no longer destined to be used. In the shown example, the foil collection unit 25 is designed to wind the portion of each of the foil webs 4*a*, 4*b* as mentioned on a reel 26*a*, 26*b* that is part of the foil collection unit 25, which does not alter the fact that other possibilities for processing the used portion of a foil web 4*a*, 4*b* are feasible within the framework of the invention. Furthermore, in the shown example, the foil collection unit 25 resembles the foil input unit 22 in a constructional sense, comprising an output carrier shaft 27 for supporting the reels 26*a*, 26*b*, a servo motor 28 for driving the output carrier shaft 27, and a magnetic powder clutch 29 for coupling the motor 28 to the output carrier shaft 27. In this configuration, it is possible to have accurate control of the motion of the output carrier shaft 27, in a similar manner as is the case with the input carrier shaft 21. It is noted that details of both the foil input unit 22 and the foil collection unit 25 can best be seen in FIG. 4.

In a manner that is known per se, the input carrier shaft 21 is designed to allow for a slipping arrangement of the reel(s) 12*a*, 12*b* on the shaft. Likewise, the output carrier shaft 27 is designed to allow for a slipping arrangement of the reel(s) 26*a*, 26*b* on the shaft. In particular, both the input carrier shaft 21 and the output carrier shaft 27 may be tension shafts, i.e. shafts having segments of variable diameter. In case the input carrier shaft 21 is used to support two reels 12*a*, 12*b*, the fact that the rotational speed of each of the reels 12*a*, 12*b* does not necessarily need to be the same but can be controlled independently allows for compensation of (slight) diameter differences between the respective reels 12*a*, 12*b*. The foil handling device 2 may be equipped with many suitable systems for measuring one or more parameters relating to reel size, the controlling arrangement 20 being configured to process the outcome of measurements performed by such system and to control a mechanism for varying the extent of slip between the respective reels 12*a*, 12*b* and the input carrier shaft 21 so as to realize proper winding processes at both reels 12*a*, 12*b*. Likewise, in case the output carrier shaft 27 is used to support two reels 26*a*, 26*b*, the fact that the rotational speed of each of the reels 26*a*, 26*b* does not necessarily need to be the same but can be controlled independently allows for compensation of (slight) diameter differences between the respective reels 26*a*, 26*b*. The foil handling device 2 may be equipped with many suitable systems for measuring one or more parameters relating to reel size, the controlling arrangement 20 being configured to process the outcome of measurements performed by such system and to control a mechanism for varying the extent of slip between the respective reels 26*a*, 26*b* and the output carrier shaft 27 so as to realize proper winding processes at both reels 26*a*, 26*b*.

Figure 5:
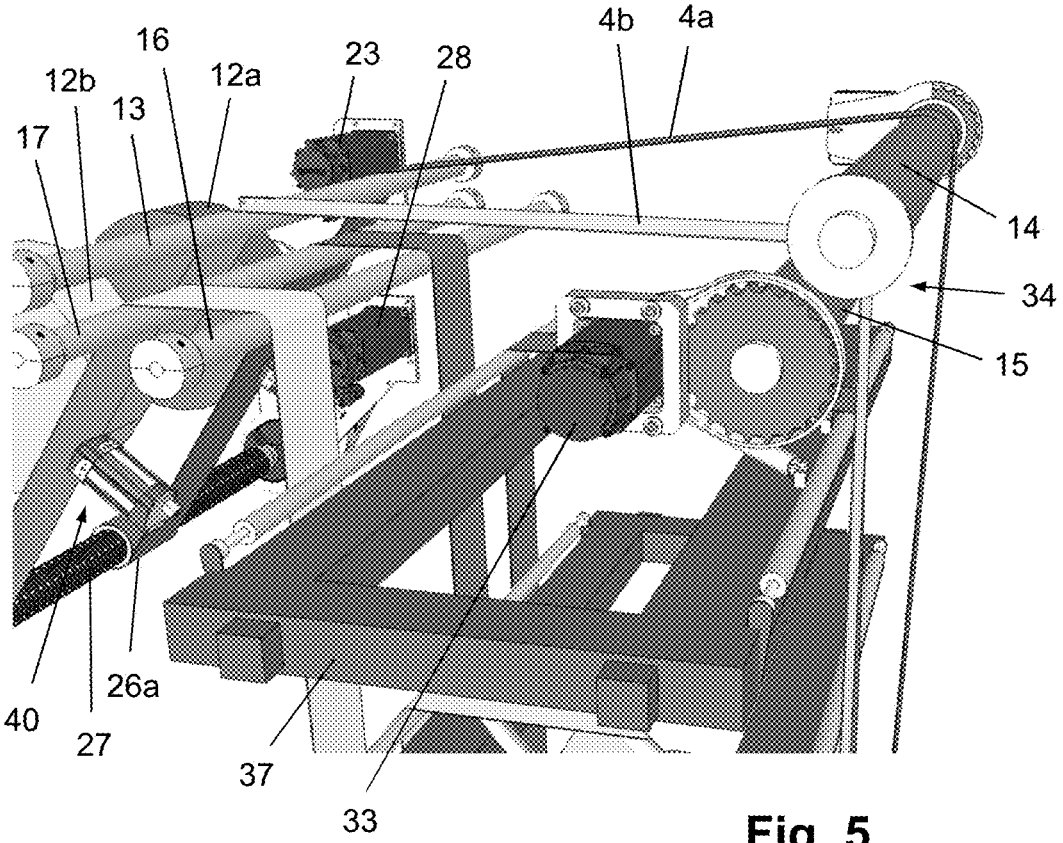
FIG. 5 shows a perspective view of a number of components as present in a second portion of the foil handling device according to the invention, including components of a direct foil drive system of the foil handling device, and portions of foil webs running through the portion of the foil handling device as shown.

As mentioned in the foregoing, the foil handling device 2 comprises two driven direct foil supply bars 14, 15 that are situated at the foil input side of the printing press 1, and that are controlled by means of the controlling arrangement 20 on the basis of information provided by the encoder unit 19 during operation, so as to have continuous adjustment of the speed of the foil webs 4*a*, 4*b* to the speed of the substrate in the printing area 3 by continuous adjustment of the rotational speed of the direct foil supply bars 14, 15 to the rotational speed of the substrate supporting cylinder 11. In the process, use is made of the fact that in each rotation of the substrate supporting cylinder 11, there is a period in which adjustment of the speed of the foil webs 4*a*, 4*b* can be initiated, namely a period in which the foil webs 4*a*, 4*b* are allowed to run free in the printing area 3. The fact is that both the blanket cylinder 10 and the substrate supporting cylinder 11 are provided with a gap 30, 31, particularly a break in their circumference, and that during a period of each rotation of the cylinders 10, 11, the gaps 30, 31 of the cylinders 10, 11 are in a position of facing each other. As is known per se, the gaps 30, 31 of the respective cylinders 10, 11 may have a function in accommodating gripping or clamping elements. For example, in the blanket cylinder 10, elements for holding the blanket to the cylinder 10 may be present in the gap 30, and in the substrate supporting cylinder 11, elements for gripping the substrate to be printed and carrying the substrate through the printing area 3 may be present in the gap 31. Each of the direct foil supply bars 14, 15 is driven by means of a servo motor 32, 33 that is controlled by the controlling arrangement 20 of the foil handling device 2 in such a way as to realize a speed of the foil webs 4*a*, 4*b* that is accurately adjusted to the speed of the substrate in the printing area 3, wherein corrections in the first speed are made during the period that the gaps 30, 31 of the respective cylinders 10, 11 as present in the printing area 3 are facing each other, that period occurs during each rotation of the cylinders 10, 11, and that period allows for relative movement of the foil webs 4*a*, 4*b* with respect to the cylinders 10, 11 in the nip between the cylinders 10, 11. Details of a direct foil drive system 34 comprising the direct foil supply bars 14, 15 and the servo motors 32, 33 for driving the bars 14, 15 can best be seen in FIG. 5.

Furthermore, as already mentioned, in the shown example, the foil handling device 2 is equipped with a foil reuse unit 18. In FIG. 2, details of an exemplary embodiment of the foil reuse unit 18 are clearly shown. In this embodiment, the foil reuse unit 18 comprises two adjustable angle bar arrangements 35, 36, and two frame portions 37, 38, wherein each of the angle bar arrangements 35, 36 is arranged in another of the frame portions 37, 38, and wherein a level of each of the frame portions 37, 38 in the foil handling device 2 is adjustable. As can be seen in FIG. 2, in the shown example of an application of two foil webs 4*a*, 4*b*, the foil reuse unit 18 is used for feeding each of the foil webs 4*a*, 4*b* an additional, second time to the printing area 3, wherein each of the foil webs 4*a*, 4*b* runs through another one of the frame portions 37, 38 of the foil reuse unit 18. The positioning of the foil webs 4*a*, 4*b* as necessary for realizing the second input of the foil webs 4*a*, 4*b* to the printing area 3 is accurately controlled, both in the longitudinal direction and the transverse direction, by controlling the level of the frame portions 37, 38 and the positions of the angle bar arrangements 35, 36 in the frame portions 37, 38. To this end, the controlling arrangement 20 of the foil handling device 2 may be configured to process information about the extent to which the foil webs 4*a*, 4*b* need to be displaced in both directions as mentioned, and to set the frame portions 37, 38 and the angle bar arrangements 35, 36 in the frame portions 37, 38 at the positions that are correct for realizing an appropriate displacement of the foil webs 4*a*, 4*b* with respect to the original input of the foil webs 4*a*, 4*b* to the printing area 3. On the basis of the displacement of the foil webs 4*a*, 4*b* in the transverse direction, it is realized that other portions of the substrate can be covered by the foil webs 4*a*, 4*b*, that have a significantly smaller width than the substrate in the shown example. On the basis of the displacement of the foil webs 4*a*, 4*b* in the longitudinal direction, it is realized that another portion of the foil webs 4*a*, 4*b* than the portion where the transfer layer is no longer present is put in contact with the substrate at positions where new transfers of material from the foil to the substrate need to take place. When the foil webs 4*a*, 4*b* have moved through the printing press 1 two times, the foil webs 4*a*, 4*b* move from the printing press 1 to the foil collection unit 25.

It follows from the foregoing that applying the foil reuse unit 18 offers the important advantage of efficient use of the foil. In a situation without a foil reuse unit 18, only one portion of the transfer layer of a foil web 4*a*, 4*b* is used in a printing process, whereas in a situation with the foil reuse unit 18, multiple portions of the transfer layer of the same foil web 4*a*, 4*b* are used in a printing process.

Figure 6:
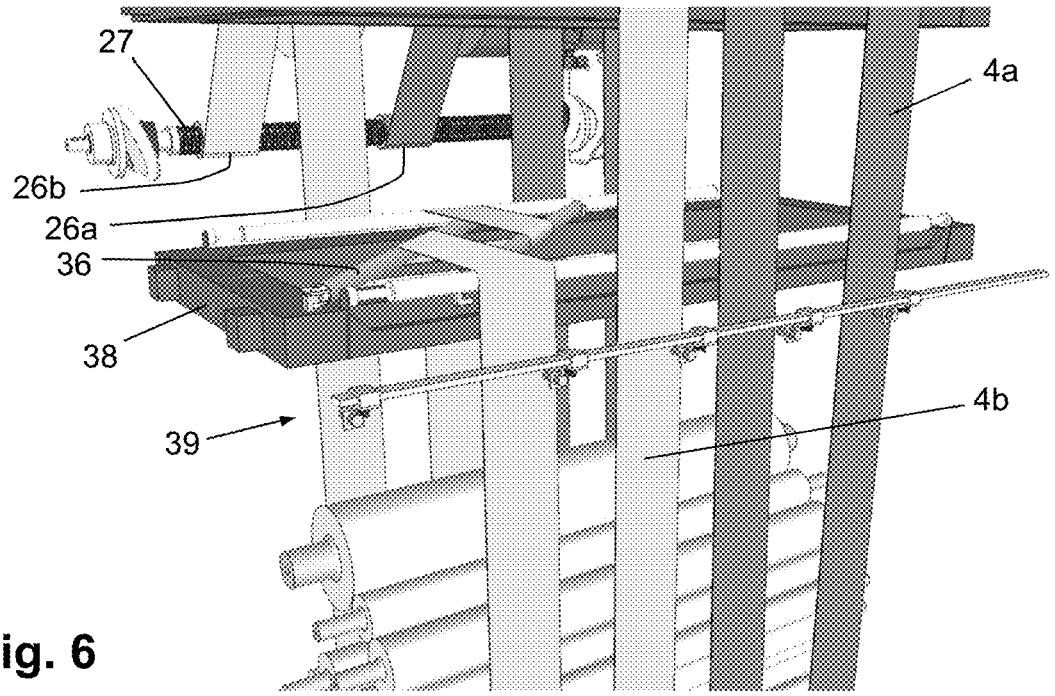
FIG. 6 shows a perspective view of a number of components as present in a third portion of the foil handling device according to the invention, including components of a visual inspection unit of the foil handling device for visually inspecting reference marks on at least one foil web to be supplied to the printing press, and portions of foil webs running through the portion of the foil handling device as shown.

The foil handling device 2 is designed to accurately control longitudinal positioning of the foil webs 4*a*, 4*b* in the printing area 3, so that it is actually possible to print many patterns as desired on a series of substrates in a reproducible manner. This is especially relevant in case the foil does not simply have a plain appearance, but is provided with a repetitive pattern of symbols, letters, images, etc. The foil handling device 2 is capable of positioning the specific pattern of the foil on substrates in a predetermined way, on the basis of the fact that the foil handling device 2 is equipped with a visual inspection unit 39 for inspecting reference marks on the foil webs 4*a*, 4*b* at the foil input side of the printing press 1, as can best be seen in FIG. 6, and the fact that the controlling arrangement 20 of the foil handling device 2 is configured to receive and process information from the visual inspection unit 39 about the longitudinal positions of the reference marks and to realize an appropriate adjustment of the longitudinal position of the foil webs 4*a*, 4*b* by means of the direct foil drive system 34 in case the longitudinal positions of the reference marks appear to deviate from reference longitudinal positions. The visual inspection unit 39 may be located at another position in the foil handling device 2 than as shown and described, as long as it is possible for the visual inspection unit 39 to inspect the reference marks on the foil webs 4*a*, 4*b* and provide relevant information that may be compared to the reference.

The visual inspection unit 39 is arranged so as to inspect a portion of the foil webs 4*a*, 4*b* running between the direct foil supply bars 14, 15 and the printing press 1. Another position of the visual inspection unit 39 in the foil handling device 2 may also be chosen. The marks to be inspected may be provided on the foil in many suitable ways, and may even be part of the pattern of the foil. In a practical situation, the marks may be of a transparent character, wherein it is possible for the visual inspection unit 39 to comprise photocells for inspecting the marks. On the basis of the fact that during a process of performing an inspection of the foil webs 4*a*, 4*b*, the visual inspection unit 39 is situated at a certain position with respect to the printing press 1, particularly the printing area 3 thereof, a distance measured along the foil webs 4*a*, 4*b* to the printing area 3 has a given value. Consequently, taking into account an actual web speed, i.e. a longitudinal speed of the foil webs 4*a*, 4*b*, it is possible to determine whether reference marks as inspected are at the right longitudinal position or not. The control can be realized so as to rely on image comparison techniques in the process.

It is also possible to use the visual inspection unit 39 as mentioned in the foregoing for realizing accurate transverse positioning of the foil webs 4*a*, 4*b* in the printing area 3. Whenever an inspected transverse position of a reference mark appears to deviate from a predetermined transverse position, the foil input unit 22 and/or the foil reuse unit 18 can be controlled to allow for the necessary adjustment. Also, it is possible to detect obliquity of the foil webs 4*a*, 4*b*, namely by making a comparison of longitudinal positions of two reference marks that are supposed to be exactly the same.

Figure 7:
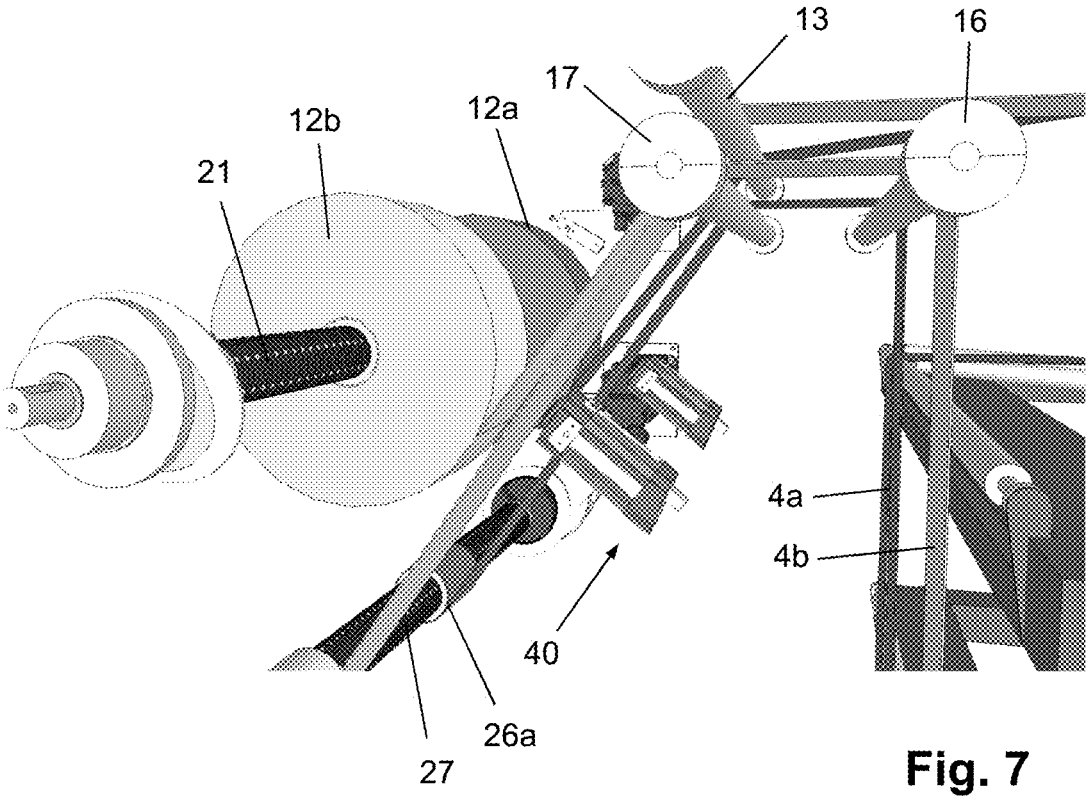
FIG. 7 shows a perspective view of a number of components as present in a fourth portion of the foil handling device according to the invention, including components of a visual inspection unit of the foil handling device for visually inspecting an actual pattern of removed transfer portions in at least one used foil web, and portions of foil webs running through the portion of the foil handling device as shown.

The foil handling device 2 comprises another visual inspection unit 40, as can best be seen in FIG. 7, which is designed to be used in a process of determining on the basis of visual input whether the web tension is at a correct level, especially a process of determining whether the web tension is not too high. The visual inspection unit 40 is especially arranged and configured to inspect an actual pattern of removed transfer portions in a used length of the foil webs 4*a*, 4*b*, and is therefore arranged at the foil output side of the printing press 1, optionally at a position for inspecting a portion of the foil webs 4*a*, 4*b* moving directly towards the foil collection unit 25. In the shown example, the visual inspection unit 40 is arranged so as to inspect the foil webs 4*a*, 4*b* at a position between the output bars 16, 17 and the foil collection unit 25.

Figure 8:
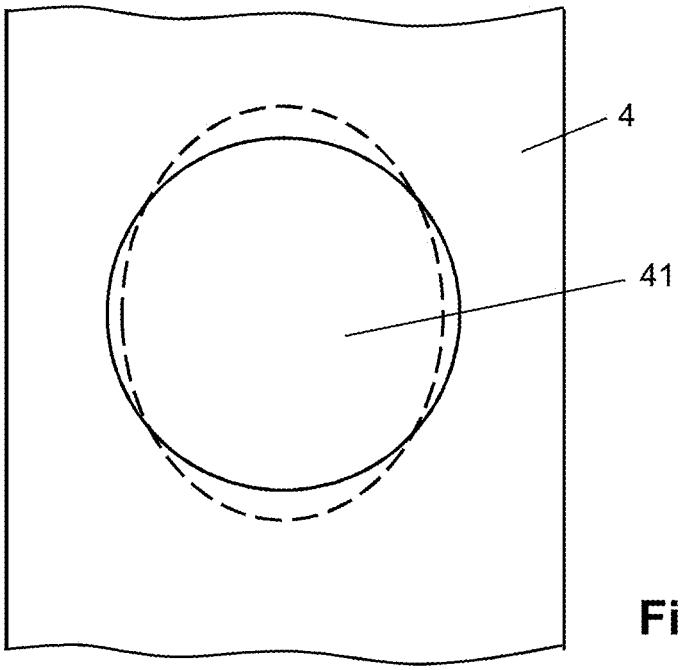
FIG. 8 illustrates how the inspected pattern of removed transfer portions can be used in a process of determining whether the web tension is not too high.

The visual inspection unit 40 may comprise many suitable types of cameras for obtaining an image from the foil webs 4*a*, 4*b*, particularly an image that shows the appearance of the foil webs 4*a*, 4*b*, particularly the pattern of the removed transfer portions. The controlling arrangement 20 of the foil handling device 2 is provided with information related to what a certain removed transfer portion should look like in a situation of correct web tension, for example, what the dimension of the removed transfer portion in the longitudinal direction should be. The fact is that at a web tension that is too high, a stretched appearance of the removed transfer portions is detected. In FIG. 8, an illustration of this fact is provided. FIG. 8 shows an example of an appearance of a removed transfer portion 41 on a length of foil web 4, according to which the removed transfer portion 41 is circular, as indicated in FIG. 8 by continuous lines. If the web tension is too high, the removed transfer portion 41 has a stretched appearance, that is an elliptical appearance in this example, as indicated in FIG. 8 by dashed lines, and that has a larger dimension in the longitudinal direction. By using image recognition techniques, or by comparing an actual longitudinal dimension to a reference longitudinal dimension, for example, the controlling arrangement 20 is capable of determining whether the web tension is at a correct level, or not. If the appearance of the removed transfer portions 41 indicates that the web tension is too high, the controlling arrangement 20 can act to make appropriate adjustments in the foil handling device 2, especially by adjusting motion and/or positioning of at least one of the input carrier shaft 21, the output carrier shaft 27 and other driven bars 14, 15 of the foil handling device 2.

Avoiding a situation of the web tension getting too high in the manner as described in the foregoing involves less waste of foil and substrates compared to a conventional way of doing in which printing results are taken as an indication, and involves a possibility to save costs compared to a conventional way of doing in which pressure on a shaft is measured and taken as an indication of the web tension.

Figure 9:
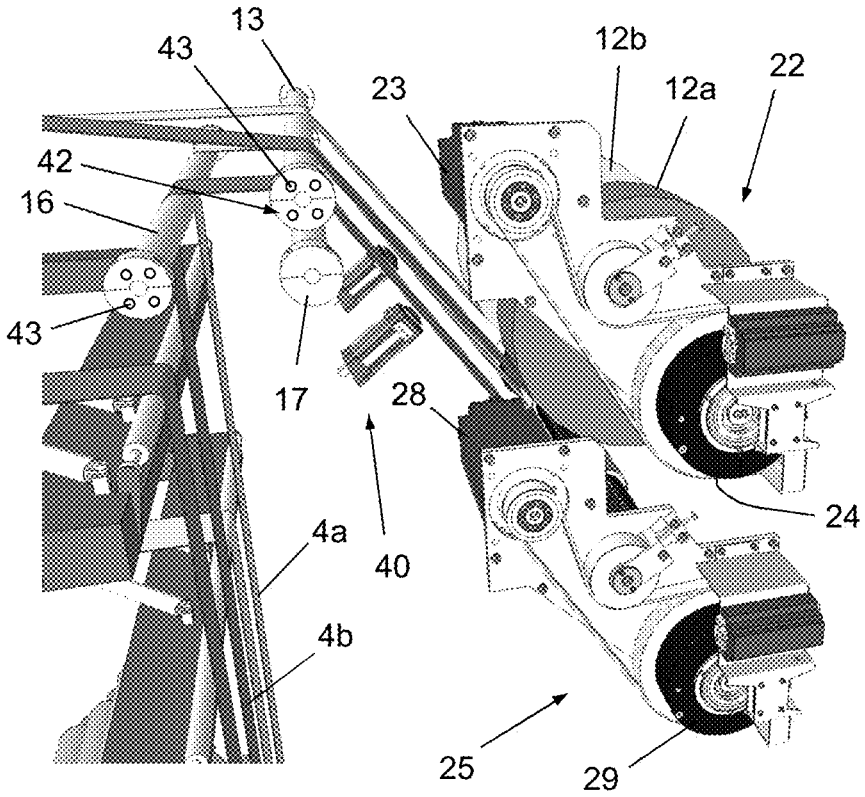
FIG. 9 is the same as FIG. 4, illustrating an option of having cells on two bars of the foil handling device according to the present invention for measuring forces applied to the respective bars by the foil web.

FIG. 9 relates to an option of using another unit 42 for determining whether the web tension is at a correct level, that unit 42 may be used in addition to the visual inspection unit 40 for inspecting an actual pattern of removed transfer portions in a used length of the foil webs 4*a*, 4*b*, as is the case in the shown example, or as an alternative of the visual inspection unit 40. The unit 42 is a pressure detection unit 42 that is arranged and configured to detect pressure exerted by the foil web 4 on at least one area of at least one of the rotatable shafts 21, 27 and bars 13, 14, 15, 16, 17 of the foil handling device 2. In the shown example, the pressure detection unit 42 comprises two sets of cells 43 that are suitable to be used for detecting an actual value of a local pressure, one set of cells 43 being arranged on the non-driven input bar 13 that is situated at the foil input side of the printing press 1, and another set of cells 43 being arranged on one of the non-driven output bars 16, 17 that are situated at the foil output side of the printing press 1, particularly the non-driven output bars 16 that is located at a position closest to the printing press 1 and the printing area 3 as seen in the longitudinal direction. Furthermore, in the shown example, each set of cells 43 comprises four cells 43 that are distributed among the circumference of the respective bar 13, 16. For the sake of completeness, it is noted that within the framework of the invention, the number of the cells 43, the distribution of the cells 43 among the rotatable shafts 21, 27 and bars 13, 14, 15, 16, 17 of the foil handling device 2 and the exact positioning of the cells 43 on the rotatable shafts 21, 27 and bars 13, 14, 15, 16, 17 can be chosen freely, wherein a skilled person will have no difficulty in designing a configuration that may be expected to yield useful measuring results, i.e. measuring results that are suitable to be used in a process of determining whether the web tension is at a predetermined value or within a predetermined range.

In case the pressure detection unit 42 as mentioned in the foregoing is used in the foil handling device 2, it is practical for the controlling arrangement 20 to be configured to receive the information about an actual value of the pressure on a bar 13, 16 from the respective cells 43, and to process that information, particularly by comparing each pressure value to a reference value of the pressure, in order to find if there are deviations from a reference situation involving a web tension as theoretically determined.

It will be clear to a person skilled in the art that the scope of the present invention is not limited to the examples discussed in the foregoing, but that several amendments and modifications thereof are possible without deviating from the scope of the present invention as defined in the attached claims.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

It is preferred if the user of the combination of the printing press 1 and the foil handling device 2 is allowed to choose which printing unit of the printing press 1 is used as a foil printing unit 5. Therefore, it is preferred if the foil handling device 2 is arranged in a displaceable support.

It is noted that in the foil handling device 2, the at least one foil web 4 is contacted by components of the foil handling device 2 only at one side, namely the side of the carrier layer, wherein damage to the transfer layer is prevented. Among other things, this is achieved by using the angle bar arrangements 35, 36 in the foil reuse unit 18.

Numerous characteristics and advantages have been set forth in the foregoing description, together with details of structure and function. While the present invention has been disclosed in several forms, it will be apparent to those skilled in the art that many modifications, additions, and deletions, especially in matters of shape, size, and arrangement of parts, can be made therein without departing from the spirit and scope of the present invention and its equivalents as set forth in the following claims. Therefore, other modifications or embodiments as may be suggested by the teachings herein are particularly reserved as they fall within the breadth and scope of the claims here appended.

What is claimed is:

1. A device comprising:

a foil input unit carrying at least one foil web having reference marks, the foil input unit arranged upstream of a printing area of a printing press;

rotatable shafts and bars arranged upstream and downstream of the printing area, respectively, for directing at least one foil web in a form of unused foil web to the printing press, and retrieving at least one foil web in a form of used foil web from the printing press;

wherein at least one of the bars arranged upstream of the printing area comprises a direct foil supply bar;

a controlling arrangement controlling operation of the device;

a motor driving the direct foil supply bar and in communication with the controlling arrangement; and a web tension feedback unit that detects at least one characteristic related to foil web tension during operation of the device, wherein the web tension feedback unit is in communication with the controlling arrangement;

wherein the controlling arrangement receives and processes information from the web tension feedback unit about the detected characteristic and compares the information to a reference;

wherein the web tension feedback unit comprises a visual inspection unit visually inspecting at least a portion of the reference marks on at least one foil web; and wherein the controlling arrangement temporarily adjusts motion of the direct foil supply bar in case the information, that includes longitudinal positions of the visually inspected reference marks, appears to deviate from the reference, that represents reference longitudinal positions, which results in adjusting positioning of the foil web in a longitudinal direction during a time that the foil web is allowed to run free in the printing area of the printing press.

2. The device of claim 1, wherein the web tension feedback unit further comprises at least one of:

a pressure detection unit that detects pressure exerted by the foil web on at least one area of at least one of the rotatable shafts and bars, and wherein the reference further represents a reference pressure; and a position detection unit that detects a position of at least one of the rotatable shafts and bars with respect to a carrier frame, wherein the at least one of the rotatable shafts and bars is resiliently mounted on the carrier frame, and wherein the reference further represents a reference position.

3. The device of claim 1, wherein the foil input unit comprises:

a rotatable input carrier shaft;

at least one reel of the foil web; and an input driving system for driving the input carrier shaft and comprising:

a motor; and a coupling unit arranged between the motor and the input carrier shaft;

wherein the coupling unit of the input driving system comprises an electronically controllable device including two rotatably arranged coupling components and a medium situated between surfaces of the coupling components facing each other, the motor of the input driving system being arranged to drive one of the coupling components, and the controlling arrangement controlling an extent of slip between the surfaces of the coupling components by varying an extent to which the medium is allowed to couple the surfaces of the coupling components to each other.

4. The device of claim 3, wherein the electronically controllable device is a magnetic powder clutch including two rotors and magnetic powder particles situated between surfaces of the rotors facing each other, the controlling arrangement controlling an extent of slip between the surfaces of the rotors by varying a supply of electrical power to the magnetic powder clutch.

5. The device of claim 3, wherein the input carrier shaft is designed to carry at least two reels of foil web and to engage the reels of foil web in a slipping fashion, the input carrier shaft being equipped with a mechanism for varying the extent of slip between the respective reels of foil web and the input carrier shaft, and the controlling arrangement controlling the mechanism.

6. The device of claim 1 further comprising a foil collection unit for collecting used foil web;

wherein the foil collection unit comprises a rotatable output carrier shaft for carrying at least one reel of foil web and reeling in foil web to the at least one reel.

7. The device of claim 6, wherein the foil collection unit comprises an output driving system for driving the output carrier shaft;

wherein the output driving system comprises a motor and a coupling unit arranged between the motor and the output carrier shaft; and wherein the coupling unit of the output driving system comprises an electronically controllable device including two rotatably arranged coupling components and a medium situated between surfaces of the coupling components facing each other, the motor of the output driving system being arranged to drive one of the coupling components, and the controlling arrangement controlling an extent of slip between the surfaces of the coupling components by varying an extent to which the medium is allowed to couple the surfaces of the coupling components to each other.

8. The device of claim 7, wherein the electronically controllable device is a magnetic powder clutch including two rotors and magnetic powder particles situated between surfaces of the rotors facing each other, the controlling arrangement controlling an extent of slip between the surfaces of the rotors by varying a supply of electrical power to the magnetic powder clutch.

9. The device of claim 7, wherein the output carrier shaft is designed to carry at least two reels of foil web and to engage the reels of foil web in a slipping fashion, the output carrier shaft being equipped with a mechanism for varying the extent of slip between the respective reels of foil web and the output carrier shaft, and the controlling arrangement controlling the mechanism.

10. The device of claim 1 further comprising a foil reuse unit for receiving a used length of foil web from a printing press and feeding the same length of foil web back to the printing press in a longitudinally shifted position so as to allow the printing press to take transfer portions from the length of foil web at positions of the length of foil web which have not been addressed during previous use of the length of foil web in the printing process.

11. The device of claim 1 further comprising a motion detection unit for detecting motion of a cylinder of a printing press for conveying a substrate through the printing area of the printing press;

wherein the motion detection unit is in communication with the controlling arrangement; and wherein the controlling arrangement processes information from the motion detection unit and controls the motor for driving the direct foil supply bar for adjusting the speed of a foil web at the position of the direct foil supply bar to the speed of the substrate in the printing area.

12. The device of claim 1, wherein the at least one foil web is moved through a nip between two cylinders of the printing press during a printing process;

wherein each of the cylinders is provided with a gap; and wherein the time that the foil web is allowed to run free in the printing area of the printing press is a time that the gaps as present in the cylinders are in a position of facing each other during a period of each rotation of the cylinders in the printing area.

13. The device of claim 1, wherein transfer portions of a layer of the foil web are transferred to a substrate to be printed in the printing area of the printing press; and wherein the reference marks on the foil web are at least one of:

reference marks that are separate from a pattern to be transferred from the foil web to the substrate; and parts of a pattern to be transferred from the foil web that are suitable to function as reference marks.

14. A printing combination comprising:

a printing press having cylinders; and the device of claim 1;

wherein the device is arranged at a position for supplying at least one foil web to the printing press; and wherein at least the foil input unit of the device is at a position that is at a higher level than cylinders of the printing press.

15. The printing combination of claim 14, wherein the foil input unit comprises a rotatable input carrier shaft for carrying at least one reel of foil web and reeling out foil web of the at least one reel, and an input driving system for driving the input carrier shaft;

wherein the input driving system comprises a motor and a coupling unit arranged between the motor and the input carrier shaft; and wherein the coupling unit of the input driving system comprises an electronically controllable device including two rotatably arranged coupling components and a medium situated between surfaces of the coupling components facing each other, the motor of the input driving system being arranged to drive one of the coupling components, and the controlling arrangement controlling an extent of slip between the surfaces of the coupling components by varying an extent to which the medium is allowed to couple the surfaces of the coupling components to each other.

16. The printing combination of claim 14, wherein the device further comprises a foil collection unit for collecting used foil web; and wherein the foil collection unit comprises a rotatable output carrier shaft for carrying at least one reel of foil web and reeling in foil web to the at least one reel.

17. The printing combination of claim 14, wherein the device further comprises a foil reuse unit for receiving a used length of foil web from a printing press and feeding the same length of foil web back to the printing press in a longitudinally shifted position so as to allow the printing press to take transfer portions from the length of foil web at positions of the length of foil web which have not been addressed during previous use of the length of foil web in the printing process.

* * * * *